US005488795A

United States Patent [19]

Sweat

[11] Patent Number: 5,488,795

[45] Date of Patent: Feb. 6, 1996

[54] MULTI-CALIBER LASER FIRING CARTRIDGE

[75] Inventor: Richard E. Sweat, Buford, Ga.

[73] Assignee: American Laser Technology, Inc., Marietta, Ga.

[21] Appl. No.: 202,144

[22] Filed: Feb. 28, 1994

[51] Int. Cl.[6] ..... F41A 33/02; F41G 3/26

[52] U.S. Cl. ..... 42/103; 362/112

[58] Field of Search ..... 42/103; 362/110, 362/111, 112; 434/21, 22, 23

[56] References Cited

U.S. PATENT DOCUMENTS

| | | | |
|---|---|---|---|
| 1,490,272 | 4/1924 | Hickam | 362/111 |
| 1,795,401 | 3/1931 | Lawrence | 362/111 |
| 3,240,924 | 3/1966 | Darby | 362/111 |
| 4,048,489 | 9/1977 | Giannetti | 42/103 |
| 4,367,516 | 1/1983 | Jacob | 362/112 |
| 4,830,617 | 5/1989 | Hancox et al. | 434/21 |
| 4,983,123 | 1/1991 | Scott | 434/21 |
| 5,241,458 | 8/1993 | Abbas | 362/110 |

*Primary Examiner*—David Brown
*Attorney, Agent, or Firm*—Henderson & Sturm

[57] ABSTRACT

A multi-caliber laser firing cartridge (10) for use with a variety of different caliber conventional firearms (100) wherein the cartridge (10) employs an adjustable position switch housing member (71) which may be movably deployed within the cartridge base unit (11) to accommodate varying firing pin "throws" within conventional firearms (100) such that the impact of the firing pin (102) on the cartridge (10) will generate and project a laser beam from the cartridge and through the barrel (104) of the firearm.

13 Claims, 3 Drawing Sheets

MULTI-CALIBER LASER FIRING CARTRIDGE

TECHNICAL FIELD

The present invention relates to the field of light emitting cartridges in general, an in particular to a laser firing cartridge which has a range of usage with a variety of calibers.

BACKGROUND ART

As can be seen by reference to the following U.S. Pat. Nos. 5,241,458; 1,795,401; 4,983,123; and 4,830,617; the prior art is replete with myriad and diverse light emitting cartridges for use in both simulated and real firearms.

While all of the aforementioned prior art constructions are more than adequate for the basic purpose and function for which they have been specifically designed, these patented constructions all share one major drawback in that their usage is restricted to a single specific caliber.

Furthermore, none of the above listed references are designed to emit a focused laser beam, which is a mandatory requirement in the specific environment in which the new cartridge construction that forms the basis of the present invention is intended to be employed (e.g. simulated situational law enforcement judgmental training apparatus).

In this environment the cartridge will be placed in the chamber of a semi-automatic weapon or into the cylinder of a revolver. When the trigger of the weapon is engaged, the firing pin on the weapon strikes the activator pin (microswitch) of the casing charging the diode and emitting a low-level infrared light. This light is directed on to a computer screen approximately the size of a room wall. Moving scenarios are projected onto the screen from a laser disc projector at a rate of 30 frames per second. The screen is reflecting the infrared light to a camera interfacing with the computer. Since each frame of the video sequence has been "mapped" with the outline of the moving target person silhouette, the computer correlates the shot to determine if it has fallen within the range of the silhouette and in what bodily location of the silhouette. The position of the "hit" is then located on the image on the screen.

As a consequence of the foregoing situation, there has existed a longstanding need among law agencies both in this country and abroad for a new type of light emitting cartridge that can be used in the law enforcement officers own firearm across a range of different caliber and types of handguns; and the provision of such a construction is a stated objective of the present invention.

DISCLOSURE OF THE INVENTION

Briefly stated, the multi-caliber laser firing cartridge that forms the basis of the present invention comprises in general a cartridge base unit, a firing pin impact unit disposed within the cartridge unit, a laser generating unit associated with the cartridge unit and a switch unit a power source unit disposed within the cartridge unit intermediate the firing pin impact unit and the laser generating unit.

In addition the laser firing cartridge is dimensioned such that a single cartridge can be operatively and interchangeably deployed in 0.357 caliber 0.38 caliber and 9 mm caliber handguns which are currently the most popular types of calibers favored by law enforcement officers.

As will be explained in greater detail further on in the specification, both the firing pin impact unit and the switch unit have been specially designed to accommodate the different standard travel lengths between firing pins in each of the aforementioned popular calibers to insure that the firing pin impact unit will establish closing contact with the switch unit regardless of the particular caliber weapon employed within the aforementioned range of calibers.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
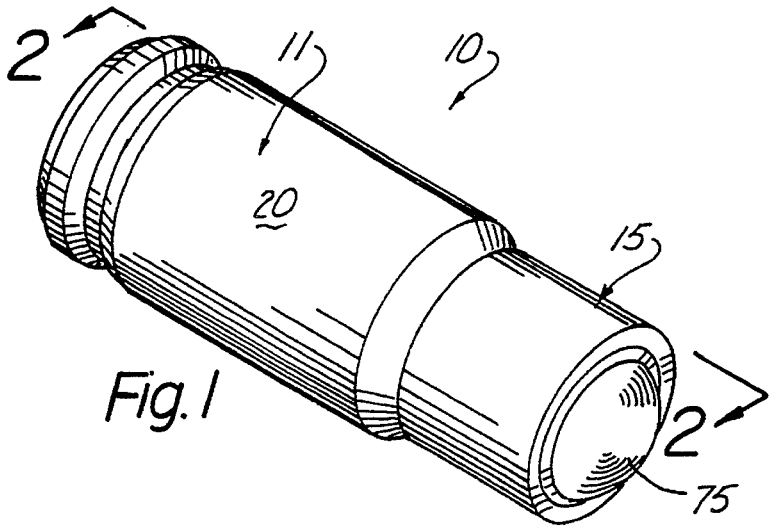
FIG. 1 is an isolated perspective view of the exterior of the multi-caliber laser firing cartridge that forms the basis of the present invention.
Figure 2:
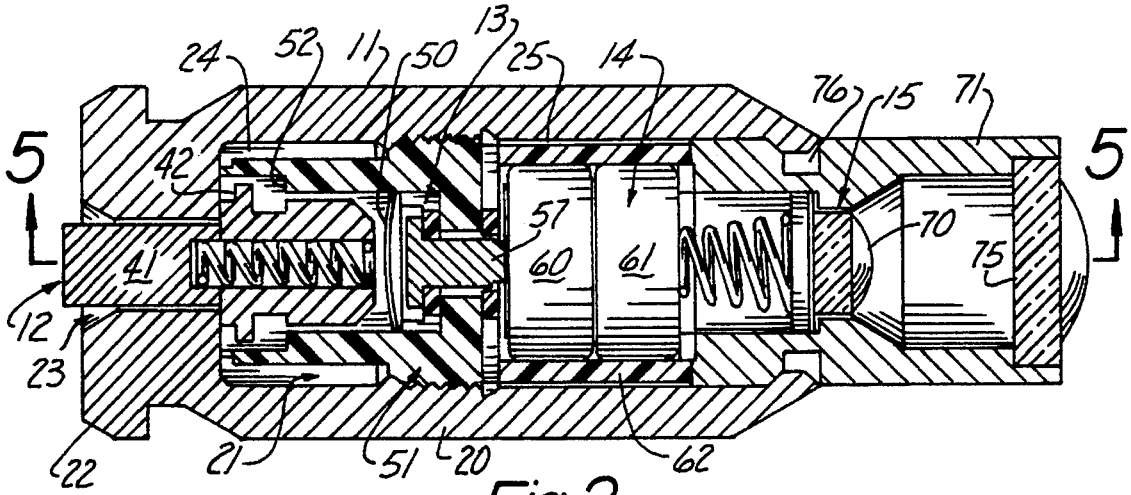
FIG. 2 is a cross-sectional view of the laser firing cartridge taken through line 2—2 of FIG. 1.

As can be seen by reference to the drawings, and in particular to FIGS. 1 and 2, the multi-caliber laser firing cartridge that forms the basis of the present invention is designated generally by the reference numeral(10). The laser firing cartridge (10) comprises in general: a cartridge base unit (11) a firing pin impact unit (12) a switch unit (13) a power source unit (14) and a laser generating and focusing unit (15). These units will now be described in seriatim fashion.

As can best be seen by reference to FIGS. 1 and 2, the cartridge base unit (11) comprises a generally hollow cylindrical electrically conductive brass casing member (20) having a stepped shoulder internal bore designated generally as (21) which passes entirely through the casing member (20) along its longitudinal axis. In addition the inboard end (22) of the casing member (20) forms a restricted throat opening (23) whose purpose and function will be explained presently.

Figure 3:
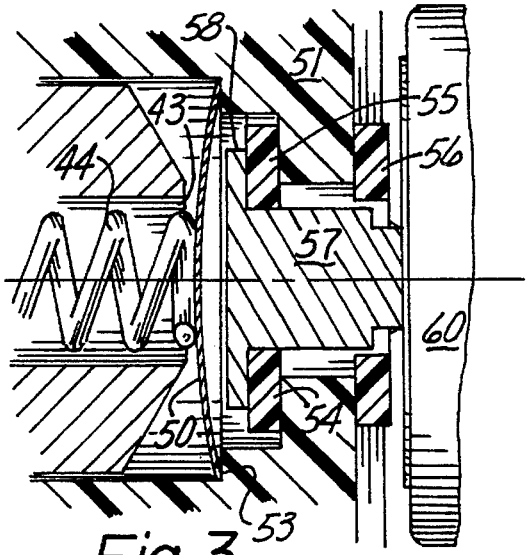
FIG. 3 is an isolated detail view of the switch unit.
Figure 5:
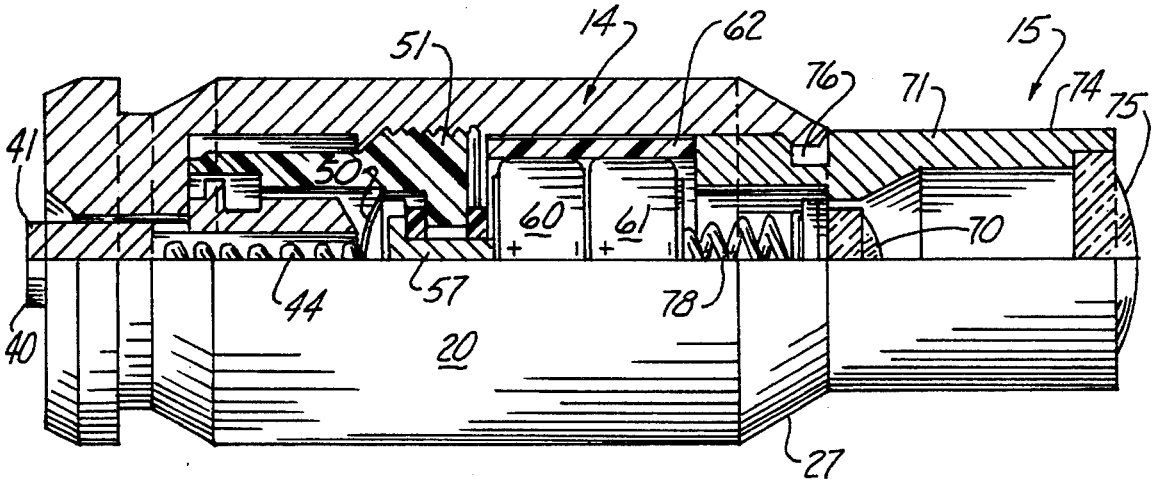
FIG. 5 is a partial cross-sectional view of the upper quadrant of the cartridge.
Figure 6:
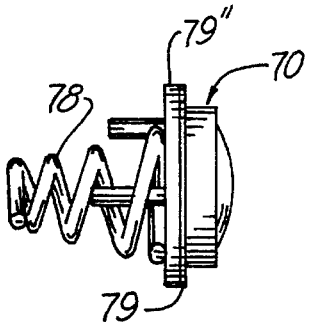
FIG. 6 is a side view of the operative engagement between the forward spring element and the laser generating member.
Figure 7:
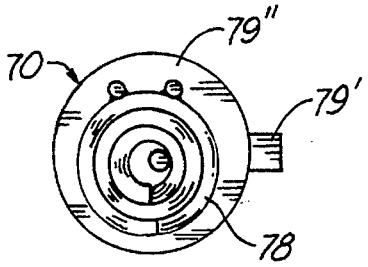
FIG. 7 is a rear view of the arrangement depicted in FIG. 6.
Figure 8:
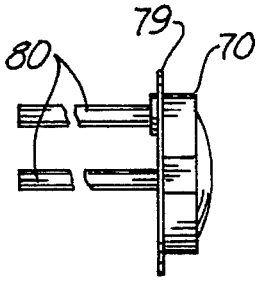
FIG. 8 is an isolated side view of the laser generating member.
Figure 9:
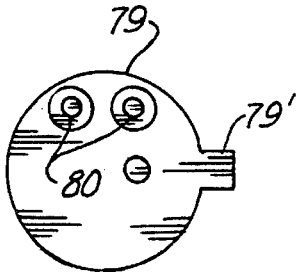
FIG. 9 is a isolated rear view of the laser generating member.

As shown in FIGS. 2, 3 and 5, the longitudinal bore (21) in the cartridge casing member (20) forms a first enlarged chamber (24) adjacent the restricted throat opening (23) within the casing member (20) wherein the throat opening (23) and the first enlarged threaded chamber (24) are dimensioned to receive the firing pin impact unit (12). The firing pin impact unit (12) comprises in general a non-conductive firing pin impact member (40) having a reduced neck portion (41) which is dimensioned to be slideably received in the restricted throat opening (23) of the casing member (20). In addition the firing pin impact member (40) is further provided with a peripheral flange (42) at the terminus of reduced neck portion (41) and has an enlarged central recess (43) formed on its outboard end; wherein the enlarged central recess (43) is dimensioned to receive a first spring biasing element (44) for reasons that will be described further on in the specification.

Turning now to FIGS. 2 and 3, it can be seen that the switch unit (13) comprises a switch member (50) disposed within a hollow switch housing member (51) dimensioned to be received within the casing member (20) in a threaded fashion. The switch housing member (51) is further provided with a central stepped shoulder bore having: a first stepped shoulder (52) which acts as a stop limit for the inward travel of the peripheral flange (42) of the firing pin impact member (40); a second stepped shoulder (53) which forms a seat for the switch member (50); and a third stepped shoulder (54) which forms a seat for one of a pair of insulating washers (55) (56) which are disposed on the interior and exterior of the switch housing member (51), and dimensioned to receive an electrically conductive contact element (57). in addition the contact element (57) is further provided with an enlarged head (58) which is disposed intermediate the switch member (50) and the first insulating washer (55) and projects through the second insulating washer for reasons that will be explained shortly.

As shown in FIGS. 2 and 5, the power supply unit (14) comprises a pair of battery members (60)(61) disposed within an insulating sleeve element (62) which electrically insulates the power supply unit (14) from the brass casing member (20); wherein, the sleeve element (62) is disposed within a second enlarged chamber (25) within the casing member (20).

Figure 4:
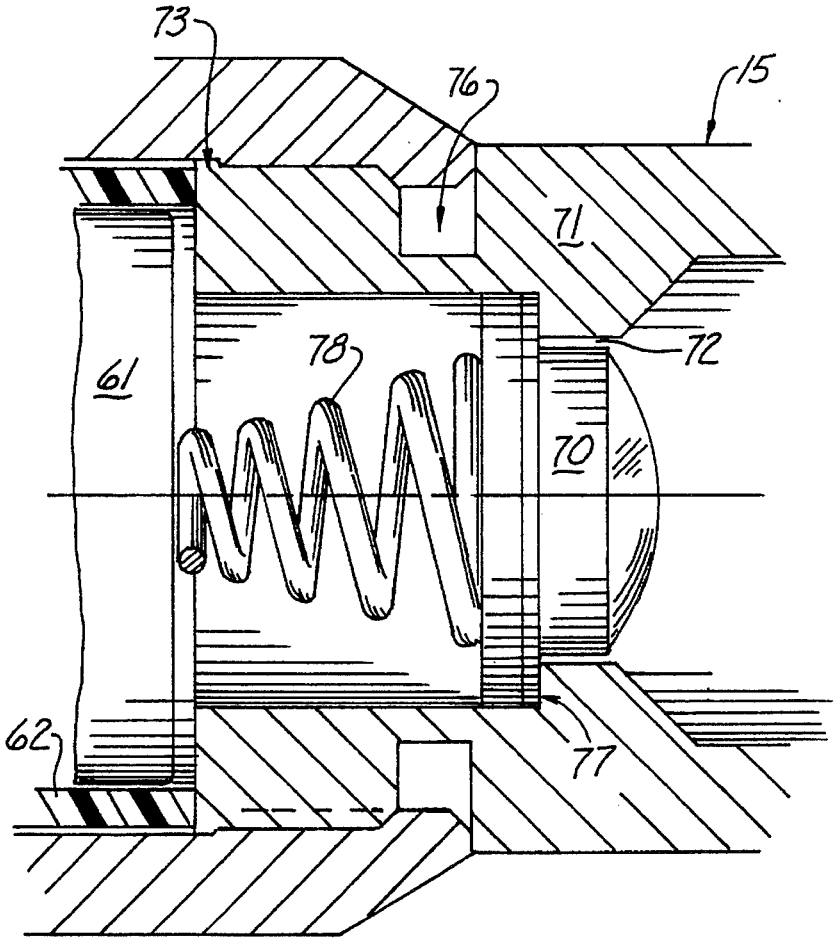
FIG. 4 is an isolated detail view of the operative connection between the power source unit and the laser generating unit.

As can be seen by reference to FIGS. 2, 4 and 5, the laser generating and focusing unit (15) comprises a laser emitting diode member (70) disposed within a hollow laser housing member (71) having a central bore with a restricted neck opening (72) disposed proximate to, but spaced from, the inboard end (73) of the laser housing member (71) which is disposed in a abutting relationship with the outboard end of the insulated sleeve element (62) of the power supply unit (14).

In addition, the outer end (74) of the laser housing unit (71) is provided with a collimating lens (75) which will focus the output of the laser emitting diode member (70). The intermediate portion of the external surface of the laser housing member (71) is provided with a peripheral recess (76) which is designed to accommodate the crimped outboard end (27) of the casing member (20) to secure the laser generating and focusing unit (15) to the cartridge base unit (11); and, the inboard end (73) of the laser housing member (71) is provided with a stepped shoulder (77) which serves as a bearing surface for a peripheral portion of the laser emitting diode (70) to rest against under the influence of a second spring biasing element (78) which is disposed intermediate the power supply unit (14) and the laser emitting diode member (70).

Turning now to FIGS. 6 through 9 it can be seen that the second spring bearing element (78) bears against an outwardly projecting shoulder (79) of the laser emitting diode (70); wherein, the inboard end of the laser emitting diode (70) is provided with an electrical contact tang (79'), an insulating washer (79"), and a plurality of rearwardly extending electrical contacts (80) which are dimensioned to engage the power source unit (14) upon actuation of the firing pin impact unit (12) as will be described in greater detail presently.

Figure 10:
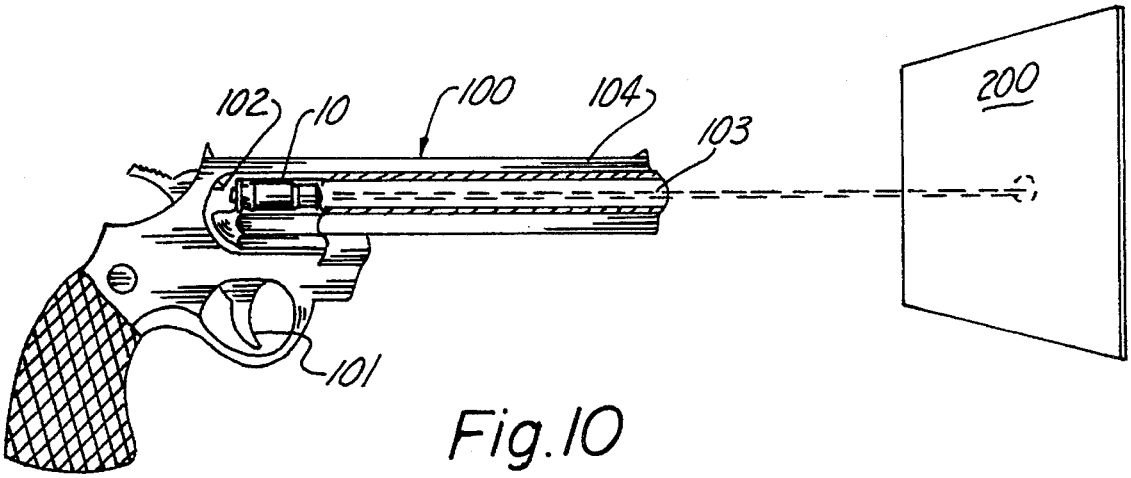
FIG. 10 is a perspective view showing the cartridge deployed in its intended environment.

As shown in FIG. 10, the cartridge (10) of this invention is intended to be employed in a conventional firearm (100) within a range of calibers that encompasses 0.357, 38 and 9 mm calibers; wherein the cartridge (10) is inserted into the firearm (100) in the conventional manner. When the trigger mechanism (101) of the firearm (100) is pulled, the firing pin (102) will contact the firing pin impact member (40) to overcome the resistance of the first spring biasing element (44) causing the firing pin impact member (40) to depress the switch member (50), and bring the switch member (50) into contact with the electrically conductive contact element (57) which subsequently engages the batteries (60)(61) then provide current to the laser emitting diode (70) which projects an infrared light through the collimating lens (75); wherein, the focused beam of light travels down the bore (103) of the barrel (104) of the firearm (100) and is projected onto a screen (200) disposed at a remote location for the reasons that have been outlined previously.

In addition, the electrical contact tang (79') on the laser emitting diode (70) is in electrical contact with the conductive laser housing member (71); wherein the electrical current passes through the laser housing member (71) back through the conductive cartridge casing member (20) and the conductive switch housing member (51 ) to the switch member (50) to complete the electrical circuit. The duration of the light beam that is generated by this process is governed by the retraction strength of the first spring biasing element (44) and the spring coefficient of the switch member (50); and, the light beam duration of preferably 30 milliseconds can be adjusted by the rotation of the threaded switch housing member (51) within the interior of the complimentary threaded portion of the casing member (20).

At this juncture it should be appreciated that the cartridge (10) that forms the basis of this invention has been specifically designed and dimensioned so that one such cartridge can be interchangeably deployed in a variety of firearms covering the range of 0.357, .38 and 9 mm calibers.

Furthermore, the laser emitting diode (70) of this invention specifically comprises an 860 manometer low level infrared light emitting diode which does not require a special Federal license for use such is required in at least one prior art device. In addition the firing pin impact member (40) and associated components are designed to accommodate both the relatively short firing pin throw of a semi-automatic firearm, such as a 9 mm of 10/1000 ths of an inch in a 0.357 revolver.

It should also be noted that the switch member (50) in the preferred embodiment of the invention comprises a very thin Belville spring disk element.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A laser firing cartridge for use in firearms wherein the cartridge comprises:

a hollow cartridge casing member having a variable diametric longitudinal bore extending therethrough wherein said longitudinal bore includes: a reduced diametric throat opening formed on one end of said cartridge casing member; and a first enlarged chamber disposed proximate to said reduced diameter throat opening a firing pin impact unit at least partially disposed within said hollow cartridge casing member and including: a firing pin impact member having a neck portion formed on one end and dimensioned to be received in the reduced diameter throat opening in the casing member, and a first spring element operatively associated with the other end of the firing pin impact member;

a switch unit disposed within the first enlarged chamber of the casing member and including: a hollow switch housing member movably disposed within the first enlarged chamber in the casing member, a switch member disposed within the switch housing member and operatively engaged with said first spring element; and, an electrically conductive contact element at least partially disposed within said switch housing member at a location normally spaced from said switch member; wherein, a portion of said contact element extends outwardly from said switch housing member;

a power supply unit disposed within said casing member wherein one end of said power supply unit is operably engaged with said contact element; and, a laser generating and focusing unit operatively attached to the other end of said casing member and including: a laser housing unit; a laser generating diode disposed proximate one end of the laser housing unit and engageable with said power supply unit; and, a collimating lens disposed on the other end of the laser housing member at a location spaced from said laser emitting diode.

2. The cartridge as in claim 1; wherein, said switch member comprises a spring washer element.

3. The cartridge as in claim 1; wherein, said power supply unit comprises:

a hollow insulated sleeve element dimensioned to be received within the interior of said hollow casing member; and, at least one battery disposed within said hollow insulated sleeve element.

4. The cartridge as in claim 3; wherein, said switch housing member is electrically conductive and said conductive contact element is provided with at least one insulated washer that electrically insulates said contact element from said switch housing member.

5. The cartridge as in claim 4; further including a second spring element operatively disposed intermediate said power supply unit and the laser generating diode.

6. The cartridge as in claim 5; wherein, the laser emitting diode is provided with an outwardly projecting shoulder and one end of said second spring element bears against said outwardly projecting shoulder.

7. The cartridge as in claim 6; wherein, the outwardly projecting shoulder on the laser emitting diode is further provided with an electrical contact tang which contacts the laser housing member.

8. A single multi-caliber laser firing cartridge for use in a variety of conventional firearms having calibers ranging from 0.357 to 9 mm; wherein, the cartridge comprises:

a hollow cartridge casing member;

a firing pin impact member at least partially disposed in said casing member;

a switch unit disposed within said casing member adjacent to said firing pin impact member and including: a hollow switch housing member; a switch member disposed within said switch housing member;

means for adjustably positioning the switch housing member within said casing member;

a power supply unit disposed within said casing member in close proximity to said switch housing member;

electrical contact means disposed intermediate the switch member and the power supply unit for establishing an electrical connection between the switch member and the power supply unit; and, a laser generating and focusing unit operatively associated with the casing member and the power supply unit; wherein, the laser generating and focusing unit includes: a laser housing unit; a laser generating diode; and, a collimating lens.

9. The cartridge as in claim 8; wherein, the means for adjustably positioning the switch housing comprises a threaded engagement between the switch housing unit and the interior of said hollow casing member.

10. The cartridge as in claim 8, further comprising:

a first spring element operatively disposed intermediate the firing pin impact member and the switch member.

11. The cartridge as in claim 10; further comprising;

a second spring element operatively disposed intermediate the power supply unit and the laser generating diode.

12. The cartridge as in claim 11; wherein, said power supply unit comprises:

an insulated sleeve element disposed in the casing member; and, at least one battery disposed within the insulated sleeve element.

13. The cartridge as in claim 12; wherein, the switch member comprises a spring washer element.

* * * * *